US008693933B2

(12) United States Patent
Tsukioka

(10) Patent No.: US 8,693,933 B2
(45) Date of Patent: Apr. 8, 2014

(54) ENDLESS BELT ASSEMBLY, FIXING DEVICE, AND IMAGE FORMING APPARATUS INCLUDING A BELT TRACKING MECHANISM

(75) Inventor: Yasutada Tsukioka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 13/067,984

(22) Filed: Jul. 13, 2011

(65) Prior Publication Data

US 2012/0027478 A1 Feb. 2, 2012

(30) Foreign Application Priority Data

Jul. 27, 2010 (JP) ..... 2010-168153

(51) Int. Cl.
*G03G 15/20* (2006.01)

(52) U.S. Cl.
USPC ..... 399/329

(58) Field of Classification Search
USPC ..... 399/162, 165, 302, 303, 308, 312, 313, 399/329
See application file for complete search history.

(56) References Cited

U.S. PATENT DOCUMENTS 6,160,978 A * 12/2000 Tsuruoka et al. ..... 399/165
7,054,570 B2 5/2006 Kishi et al.
7,116,923 B2 10/2006 Kishi et al.
7,130,555 B2 10/2006 Kishi et al.
7,209,675 B2 4/2007 Matsusaka et al.
7,212,758 B2 5/2007 Kishi et al.
7,212,759 B2 5/2007 Kishi et al.
7,239,821 B2 7/2007 Matsusaka et al.
7,308,216 B2 12/2007 Kishi et al.
7,333,743 B2 2/2008 Kishi et al.
7,343,113 B2 3/2008 Matsusaka et al.
7,346,295 B2 * 3/2008 Mochimaru ..... 399/165
7,356,270 B2 4/2008 Matsusaka et al.

(Continued)

FOREIGN PATENT DOCUMENTS

JP 2002-372872 A 12/2002
JP 3731031 B2 10/2005

(Continued)

OTHER PUBLICATIONS

English language abstract for JP-2006-259540 which corresponds to JP-4597728-B2.

(Continued)

*Primary Examiner* — William J Royer
(74) *Attorney, Agent, or Firm* — Harness, Dickey & Pierce, P.L.C.

(57) ABSTRACT

An endless belt assembly includes one or more rollers, an endless belt, and a belt tracking mechanism. The one or more rollers are disposed parallel to each other, each being rotatable around a rotational axis thereof. The endless belt is looped for rotation around the rollers. The belt tracking mechanism is disposed on at least one side of the endless belt assembly to prevent lateral displacement of the endless belt during rotation. The belt tracking mechanism includes an annular recess, an annular flange, and a circumferential rib. The annular recess is perimetrically formed on a longitudinal end face of the roller. The annular flange is disposed in the annular recess to rotate freely with respect to the roller. The circumferential rib extends along a side edge of an interior circumferential surface of the endless belt to contact the annular flange upon lateral movement of the endless belt.

11 Claims, 7 Drawing Sheets

(56) References Cited

U.S. PATENT DOCUMENTS

| | | | |
|---|---|---|---|
| 7,366,432 | B2 | 4/2008 | Kishi et al. |
| 7,373,094 | B2 | 5/2008 | Kishi et al. |
| 7,496,309 | B2 | 2/2009 | Matsusaka et al. |
| 7,515,845 | B2 | 4/2009 | Kishi et al. |
| 7,551,869 | B2 | 6/2009 | Kishi et al. |
| 7,565,087 | B2 | 7/2009 | Matsusaka et al. |
| 7,603,049 | B2 | 10/2009 | Kishi et al. |
| 7,609,988 | B2 | 10/2009 | Kishi et al. |
| 7,664,410 | B2 | 2/2010 | Takagi |
| 7,885,569 | B2 | 2/2011 | Kishi et al. |
| 2004/0245241 | A1 | 12/2004 | Kishi et al. |
| 2004/0247332 | A1 | 12/2004 | Kishi et al. |
| 2004/0247334 | A1 | 12/2004 | Kishi et al. |
| 2004/0258426 | A1 | 12/2004 | Kishi et al. |
| 2005/0123315 | A1 | 6/2005 | Kishi et al. |
| 2005/0139584 | A1 | 6/2005 | Kishi et al. |
| 2005/0175368 | A1 | 8/2005 | Matsusaka et al. |
| 2005/0175370 | A1 | 8/2005 | Matsusaka et al. |
| 2005/0191078 | A1 | 9/2005 | Kishi et al. |
| 2006/0039713 | A1 | 2/2006 | Kishi et al. |
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0127118 | A1 | 6/2006 | Kishi et al. |
| 2006/0182460 | A1 | 8/2006 | Kishi et al. |
| 2007/0014600 | A1 | 1/2007 | Ishii et al. |
| 2007/0031159 | A1 | 2/2007 | Kishi et al. |
| 2007/0212090 | A1 | 9/2007 | Matsusaka et al. |
| 2008/0145088 | A1 | 6/2008 | Matsusaka et al. |
| 2009/0123172 | A1 | 5/2009 | Kishi et al. |
| 2009/0317113 | A1 | 12/2009 | Kishi et al. |
| 2011/0058839 | A1 | 3/2011 | Tsukioka |

FOREIGN PATENT DOCUMENTS

| | | | |
|---|---|---|---|
| JP | 2007-079399 | A | 3/2007 |
| JP | 2007-232925 | A | 9/2007 |
| JP | 2007-248600 | | 9/2007 |
| JP | 2008-169008 | A | 7/2008 |
| JP | 2008-216444 | A | 9/2008 |
| JP | 2009-134172 | A | 6/2009 |
| JP | 2010-128436 | | 6/2010 |
| JP | 4597728 | B2 | 10/2010 |

OTHER PUBLICATIONS

English language abstract for JP-2009-134172 which corresponds to JP-3731031-B2.

Japanese Office Action dated Jan. 7, 2014 issued in corresponding Japanese Appln. No. 2010-168153.

* cited by examiner

ENDLESS BELT ASSEMBLY, FIXING DEVICE, AND IMAGE FORMING APPARATUS INCLUDING A BELT TRACKING MECHANISM

CROSS-REFERENCE TO RELATED APPLICATIONS

The present patent application claims priority pursuant to 35 U.S.C. §119 from Japanese Patent Application No. 2010-168153, filed on Jul. 27, 2010, which is hereby incorporated by reference herein in its entirety.

BACKGROUND OF THE INVENTION

1. Field of the Invention

The present invention relates to an endless belt assembly, a fixing device, and an image forming apparatus employing the same, and more particularly, to an endless belt assembly including an endless looped belt entrained around multiple rollers applicable to a fixing device that fixes a toner image in place on a recording medium with heat and pressure, and an electrophotographic image forming apparatus, such as a photocopier, facsimile machine, printer, plotter, or multifunctional machine incorporating several of those imaging functions, employing such an endless belt assembly.

2. Description of the Background Art

In electrophotographic image forming apparatuses, such as photocopiers, facsimile machines, printers, plotters, or multifunctional machines incorporating several of those imaging functions, a toner image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner particles with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the recording medium under heat and pressure.

A specific type of such fixing device comprises a fuser belt assembly that includes an endless, looped fuser belt entrained around multiple support rollers disposed parallel to each other to define a path of movement in which the fuser belt rotates during operation. Due to low thermal capacity of the fuser belt resulting in a short warm-up time required upon activation, this type of fixing device is employed in modern printing systems that require high-speed, power-efficient fixing capabilities.

One problem associated with a multi-roller, fuser belt assembly depicted above is lateral misalignment or displacement of the fuser belt from its desired path of movement. The problem occurs where the fuser belt rotating around the multiple support rollers slips laterally in an axial direction parallel to longitudinal, rotational axes of the belt support rollers, and ultimately climbs sideways over the outer circumference of the support roller to a position deviating from the original path of movement around the multiple support rollers.

Lateral displacement of the fuser belt, if not corrected, would result in various operational failures, such as imaging defects and belt breakage, due to improper positioning of the fuser belt relative to the belt support roller. Such a problem is particularly pronounced in high-speed, power-efficient applications where the belt support roller is formed of silicone rubber for obtaining a reduced thermal capacity, or is dimensioned to have a smaller diameter for accommodating an increased circumferential speed.

To date, various techniques have been proposed to counteract lateral displacement of an endless looped belt.

For example, one such technique provides a belt tracking mechanism for an endless belt entrained around multiple support rollers, including a pair of ribs or protrusions each extending along a side edge on an interior circumferential surface of the endless belt adjoining the support rollers. During operation, the belt rib contacts an end face of the belt support roller so as to restrict lateral movement of the endless belt, which then can travel in a desired path of movement.

Another technique provides a belt tracking mechanism including an endless belt with a pair of circumferential edge ribs each facing an end face of a support roller, as well as a friction member mounted on each end face of the support roller to frictionally contact the belt rib to restrict lateral movement of the endless belt during rotation.

With reference to FIGS. 1A and 1B, which are fragmentary perspective and elevational views, respectively, of such a belt tracking mechanism, an endless belt 91 is shown entrained around a support roller 92 rotatable about a roller shaft 92*a* extending in a longitudinal, axial direction. A circumferential edge rib 91*a* extends along a side edge on an interior circumferential surface of the endless belt 91. An annular, friction flange 93 is supported on the roller shaft 92*a* to rotate freely, i.e., independent of and relative to the support roller 92 as it contacts a journal of the rotating support roller 92.

In such an arrangement, provision of the friction flange 93 reduces load on the endless belt 91 and the support roller 92 where lateral displacement of the endless belt 91 causes the edge rib 91*a* to interfere with the end face of the support roller 92 to destabilize rotation of the endless belt 91, which would otherwise aggravate the belt tendency to climb over the roller circumference upon minor slippage of the belt during rotation.

Still another technique provides an improved belt tracking mechanism similar to that depicted above, wherein the annular friction flange 93 of the support roller 92 and the circumferential edge rib 91*a* of the endless belt 91 have their interfacing surfaces beveled or inclined to effectively prevent the endless belt 91 from climbing over the outer circumference of the support roller 92.

Although advantageous for their intended purposes, the belt tracking techniques described above would not function properly, where the belt rib interferes with the end face of the belt support roller to cause undue load on the rotating belt and rollers, resulting in destabilized rotation of the endless belt, and therefore aggravated belt tendency to climb over the roller circumference.

As mentioned earlier, such malfunctioning may be alleviated by providing a friction member as that depicted above with reference to FIGS. 1A and 1B. Unfortunately, however, this is not the case with high speed applications where the belt support roller is relatively large in diameter. As shown in FIG. 1C, with such a large-diameter support roller 92 supporting the endless belt 91, the annular friction flange 93 tends to tilt relative to the longitudinal axis of the support roller 92 as it interferes with the edge rib 91*a* upon lateral displacement of the endless belt 91, resulting in a non-uniform, inconsistent contact between the annular friction flange 93 and the roller journal, which adversely affects rotation of the annular friction flange 93, thereby causing undue load on the rotating endless belt 91 and the support roller 92.

Recent trends in printing systems toward higher processing speed involve accelerating rotational speed of the multi-roller belt assembly with a corresponding increase in the diameter of the belt support roller, which makes it even more difficult to provide a reliable belt tracking mechanism with high immunity against belt failure due to lateral displacement of an endless looped belt.

SUMMARY OF THE INVENTION

Exemplary aspects of the present invention are put forward in view of the above-described circumstances, and provide a novel endless belt assembly.

In one exemplary embodiment, the novel endless belt assembly includes one or more rollers, an endless belt, and a belt tracking mechanism. The one or more rollers are disposed parallel to each other, each being rotatable around a rotational axis thereof. The endless belt is looped for rotation around the rollers. The belt tracking mechanism is disposed on at least one side of the endless belt assembly to prevent lateral displacement of the endless belt during rotation. The belt tracking mechanism includes an annular recess, an annular flange, and a circumferential rib. The annular recess is perimetrically formed on a longitudinal end face of the roller. The annular flange is disposed in the annular recess to rotate freely with respect to the roller. The circumferential rib extends along a side edge of an interior circumferential surface of the endless belt to contact the annular flange upon lateral movement of the endless belt. The circumferential rib has an inner, beveled surface to face the annular flange. The beveled surface is inclined at a first acute angle relative to the rotational axis of the roller, so that the beveled surface is farthest from the annular flange at a free edge thereof separated from the endless belt, and closest to the annular flange at a fixed edge thereof connected to the endless belt. The annular flange has an outer, chamfered surface to face the circumferential rib. The chamfered surface is inclined at a second acute angle greater than the first acute angle relative to the rotational axis of the roller.

Other exemplary aspects of the present invention are put forward in view of the above-described circumstances, and provide a fixing device incorporating an endless belt assembly.

Still other exemplary aspects of the present invention are put forward in view of the above-described circumstances, and provide an image forming apparatus employing an endless belt assembly.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
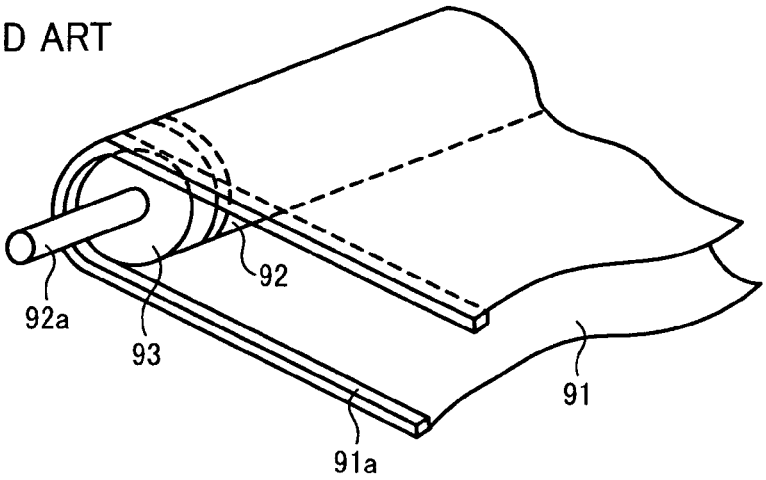
FIG. 1A BACKGROUND ART
FIGS. 1A through 1C schematically illustrate a belt tracking mechanism for an endless belt entrained around a support roller.
Figure 1B:
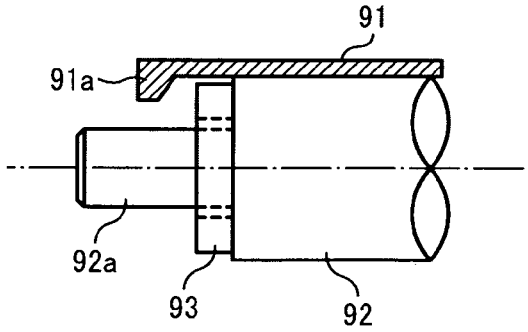
FIG. 1B BACKGROUND ART
Figure 1C:
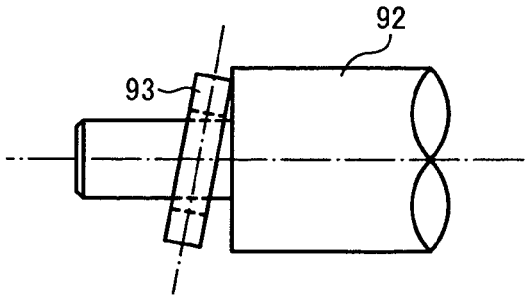
FIG. 1C BACKGROUND ART

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
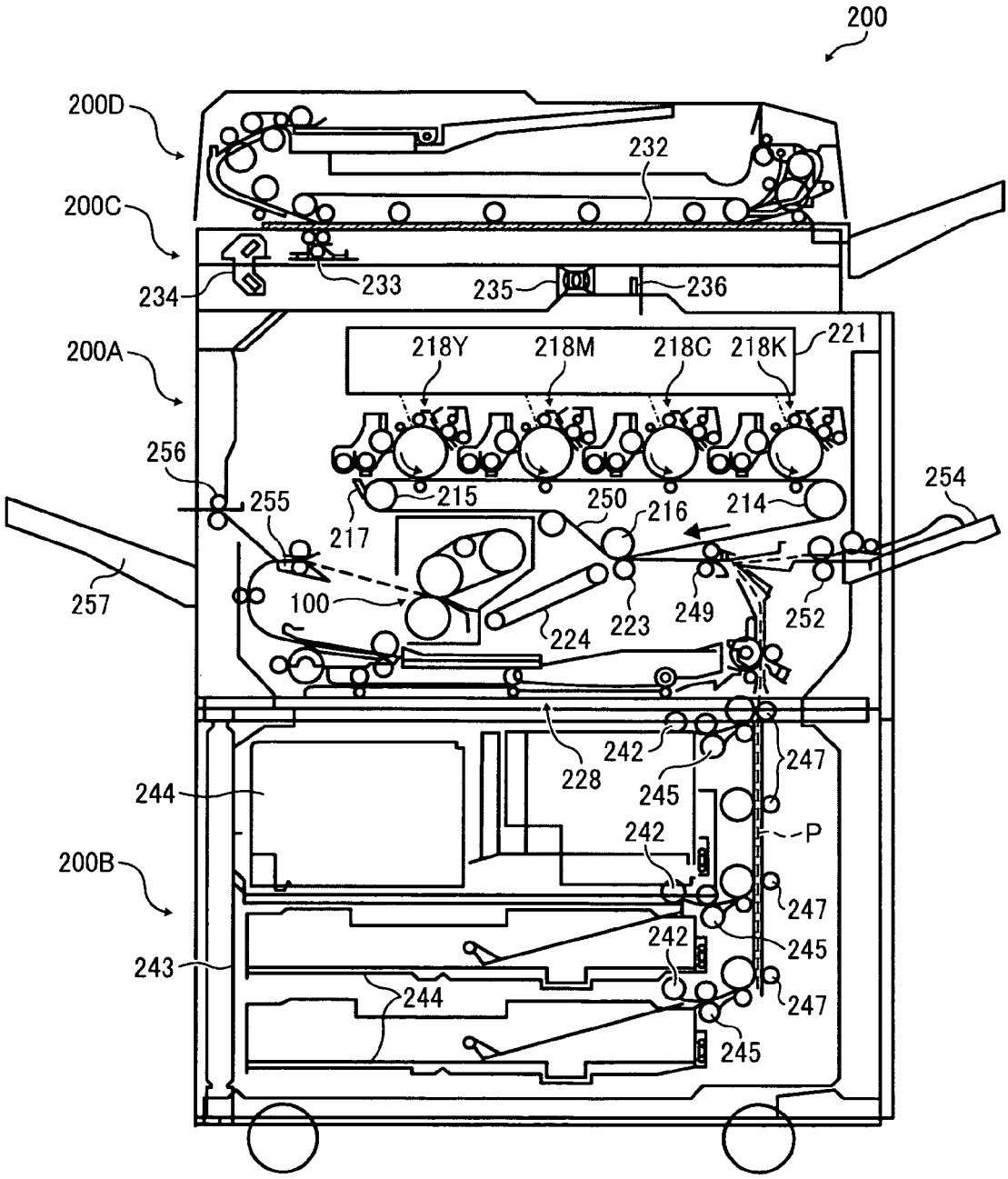
FIG. 2 schematically illustrates an image forming apparatus incorporating a fixing device according to one embodiment of this patent specification.

FIG. 2 schematically illustrates an image forming apparatus 200 incorporating a fixing device 100 according to one embodiment of this patent specification.

As shown in FIG. 2, the image forming apparatus 200 is a high-speed, digital color imaging system that can print a color image on a recording medium such as a sheet of paper S according to image data, consisting of an upper, printer section 200A, and a lower, sheet feeding section 200B, as well as an image scanner 200C and an automatic document feeder (ADF) 200D deployed atop the printer section 200A, all of which are combined together to form a freestanding unit.

The printer section 200A comprises a tandem color printer that forms a color image by combining images of yellow, magenta, and cyan (i.e., the complements of three subtractive primary colors) as well as black, consisting of four electrophotographic imaging stations 218Y, 218M, 218C, and 218K arranged in series substantially laterally along the length of an intermediate transfer belt 250, each forming an image with toner particles of a particular primary color, as designated by the suffixes "Y" for yellow, "M" for magenta, "C" for cyan, and "K" for black.

Each imaging station 218Y, 218M, 218C, and 218K includes a drum-shaped photoconductor rotatable counterclockwise in the drawing, surrounded by various pieces of imaging equipment, such as a charging device, a development device accommodating toner of the associated primary color, a primary transfer device incorporating an electrically biased, primary transfer roller, a cleaning device for a photoconductive surface, and the like, as well as an exposure device 221, which work in cooperation to form a primary toner image on the photoconductor for subsequent transfer to the intermediate transfer belt 250 at a primary transfer nip defined between the photoconductor and the primary transfer roller.

The intermediate transfer belt 250 is trained around multiple support rollers 214, 215, and 216 to rotate clockwise in the drawing, passing through the four primary transfer nips sequentially to carry thereon a multi-color toner image toward a secondary transfer nip defined between a secondary transfer roller 223 and the belt support roller 216 for transferring the toner image to a recording sheet S, and then to a belt cleaner 217 for removing residual toner remaining on the belt surface after secondary transfer.

The sheet feeding section 200B includes a media storage 243 formed of one or more sheet trays 244 each equipped with a pickup roller 242 and a separator roller 245, a manual sheet tray 254 equipped with a pickup roller 252, as well as multiple conveyance rollers 247 and other guide mechanism, which together define a sheet conveyance path P for conveying a recording sheet S from the respective sheet tray to between a pair of registration rollers 249, then through the secondary transfer nip, and then along a belt conveyor 224 into the fixing device 100.

The fixing device 100 incorporates an endless fuser belt assembly with a pressure member which operate together to fix the toner image in place on the recording sheet S with heat and pressure. A detailed description of the fixing device 100 and its associated structure will be given later with reference to FIG. 3 and subsequent drawings.

To make a full-color copy from an original document with the image forming apparatus 200, a user initially places the original in an input tray of the automatic document feeder 200D. Alternatively, the user may initially lift the automatic document feeder 200D to place the original onto a contact glass 232 of the image scanner 200C, and then restores the automatic document feeder 200D into the original position.

With the original document thus set in position, the user presses a start button provided at a user interface. Pressing the start button activates the image scanner 200C immediately (or after the original document is automatically fed to the contact glass 232 in case the automatic document feeder 200D is used), so that a first scanning element 233 illuminates the original with light from a light source, followed by a second scanning element 234 deflecting light reflected off the original through an imaging lens 235 toward a read sensor 236, which then analyzes the incoming light to obtain image data of the four primary colors for subsequent transmission to the respective imaging units 218Y, 218M, 218C, and 218K.

In the printer section 200A, each imaging station 218Y, 218M, 218C, and 218K rotates the photoconductor clockwise in the drawing to forward its outer, photoconductive surface to a series of electrophotographic processes, including charging, exposure, development, transfer, and cleaning, in one rotation of the photoconductor.

First, the photoconductive surface is uniformly charged by the charging device and subsequently exposed to a modulated laser beam emitted from the exposure device 221. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 250 through the primary transfer nip.

As the multiple imaging stations 218Y, 218M, 218C, and 218K sequentially produce toner images of different colors at the four transfer nips along the belt travel path, the primary toner images are superimposed one atop another to form a single multicolor image on the moving surface of the intermediate transfer belt 250 for subsequent entry to the secondary transfer nip between the secondary transfer roller 223 and the belt support roller 216.

Meanwhile, the sheet feeding section 200B selectively activates one of the pickup rollers 242 to pick up recording sheets S from atop the sheet stack in the sheet tray 244, followed by the separator roller 245 separating the sheets S one by one to introduce each separated sheet S between the pair of registration rollers 249 being rotated. Alternatively, in case of manual feeding, the sheet feeding section 200B activates the pickup roller 252 to pick up a recording sheet S from the manual input tray 254, and introduces it between the pair of registration rollers 249 being rotated.

Upon receiving the incoming sheet S, the registration rollers 249 stop rotation to hold the sheet S therebetween, and then advance it in sync with the movement of the intermediate transfer belt 250 to the secondary transfer nip. The registration rollers 249 may be electrically biased to repel paper dust resulting from the recording sheet S. Otherwise, the registration rollers 249 may rest connected to ground as is the case with a typical conveyor roller.

At the secondary transfer nip, the multicolor image is transferred from the intermediate transfer belt 250 to the recording sheet S. After secondary transfer, the intermediate transfer belt 250 is cleared of residual toner for preparation to a future print job, whereas the recording sheet S is introduced into the fixing device 100 to fix the toner image in place under heat and pressure.

The recording sheet S, thus having its first side printed, is forwarded to a sheet diverter 255, which directs the incoming sheet S to an output roller pair 256 for output to an output tray 257 when simplex printing is intended, or alternatively, to a sheet reversing unit 228 when duplex printing is intended.

For duplex printing, the sheet reversing unit 228 turns over the incoming sheet S for reentry to the sheet conveyance path P, wherein the reversed sheet S again undergoes electrophotographic imaging processes including registration through the registration roller pair 249, secondary transfer through the secondary transfer nip, and fixing through the fixing device 100 to form another print on its second side opposite the first side.

Upon completion of simplex or duplex printing, the recording sheet S is output to the output tray 257 for stacking outside the apparatus body, which completes one operational cycle of the image forming apparatus 200.

The image forming apparatus 200 depicted above may employ one or more multi-roller, endless belt assembly formed of an endless belt entrained around multiple rollers disposed parallel to each other, such as those employed in the fixing device 100 and the sheet or document handling mechanism. Such an endless belt assembly includes a belt tracking mechanism that can effectively prevent lateral misalignment or displacement of the endless belt during rotation around the support rollers. Embodiments of the endless belt assembly according to this patent specification are depicted herein below, in which the belt tracking mechanism is incorporated in the fuser belt assembly of the fixing device 100.

Figure 3:
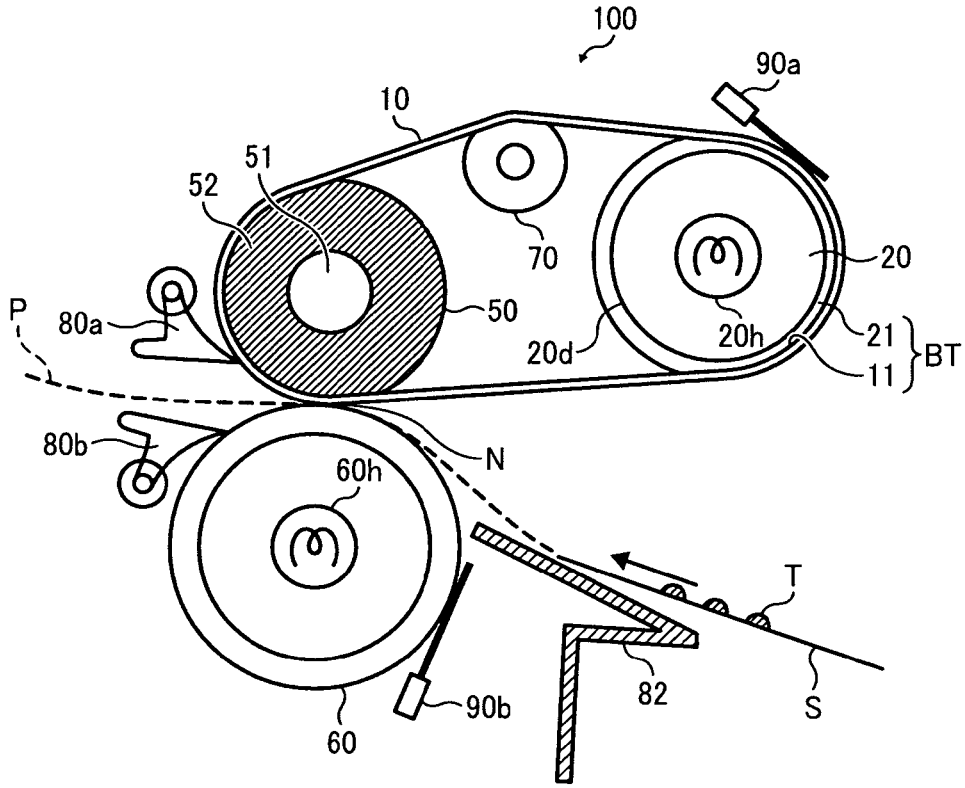
FIG. 3 is an end-on, axial cutaway view schematically illustrating the fixing device incorporating an endless belt assembly according to one embodiment of this patent specification.

FIG. 3 is an end-on, axial cutaway view schematically illustrating the fixing device 100 incorporating an endless belt assembly according to one embodiment of this patent specification.

As shown in FIG. 3, the fixing device 100 includes a rotary, endless fuser belt 10 entrained for rotation around a fixing roller 50, a heat roller 20, and a tension roller 70, as well as a rotary pressure roller 60 pressed against the fixing roller 50 through the fuser belt 10 to form a fixing nip N therebetween, all of which extend in an axial, longitudinal direction perpendicular to the sheet of paper on which the figure is drawn. A pair of first and second sheet strippers 80*a* and 80*b* are disposed opposed to each other, the former facing the fuser belt 10 and the latter facing the pressure roller 60, downstream from the fixing nip N along the sheet conveyance path P.

In the present embodiment, the fuser belt 10 comprises a rotatable endless belt formed of a substrate of stiff material upon which is deposited at least an outer layer of elastic material. For example, the fuser belt 10 may be a bi-layered belt consisting of a substrate of nickel, stainless steel, or polyimide, coated with an elastic layer of silicone rubber deposited thereupon.

The fixing roller 50 comprises a solid, motor-driven rotatable cylinder, consisting of a cylindrical core 51 of metal covered by an elastic layer 52 of silicone rubber or the like deposited thereupon, with a rotary motor connected to the metal core 51 to impart rotation to the cylindrical body. To obtain short warm-up time, sponged silicone rubber may be used to form the outer elastic layer 52, which does not absorb excessive heat to cause conductive heat loss where the fixing roller 50 contacts the fuser belt 10.

The heat roller 20 comprises a hollow, rotatable cylinder of thermally conductive metal, such as iron or aluminum, which accommodates a radiant, halogen heater 20*h* in its hollow interior to supply heat to the fuser assembly. The heater 20*h* may comprise any type of heater, such as an electromagnetic induction coil or a thin sheet of resistive heating element, instead of a radiant heater, as long as it can properly heat the fixing nip N to a desired temperature. Operation of the heater 20*h* is controlled according to readings of a thermometer or thermistor 90*a* disposed adjacent to the heat roller 20 to detect temperature of the fuser belt 10, so as to heat the fuser belt 10 properly, for example, to a temperature suitable for fusing toner in use.

The pressure roller 60 comprises a cylindrical roller consisting of a hollow, rotatable core of metal, such as iron, aluminum, or the like, covered by an elastic layer of silicone rubber or the like deposited thereupon. Although not shown in the drawing, a biasing mechanism is provided to press the pressure roller 60 against the fixing roller 50 with a regulated constant pressure, so that the pressure roller 60 establishes sliding contact with the rotating fuser belt 10 at the fixing nip N.

Optionally, the pressure roller 60 may have a dedicated internal radiant heater 60*h* accommodated in its hollow interior. The heater 60*h* may comprise any type of heater, such as an electromagnetic induction coil or a thin sheet of resistive heating element, instead of a halogen heater, as long as it can properly heat the fixing nip N to a desired temperature. Operation of the heater 60*h* is controlled according to readings of a thermometer or thermistor 90*b* disposed adjacent to the pressure roller 60 to detect temperature of the roller surface, so as to heat the pressure roller 60 where required, for example, to a temperature desirable for heating the fixing nip N upon entry of a recording sheet S.

The first and second sheet strippers 80*a* and 80*b* each comprises an elongated, multi-fingered member provided with multiple fingers arranged in the axial direction. The finger tips of the first sheet stripper 80*a* adjoin the fuser belt 10 to allow a recording sheet S to separate from the belt surface at the exit of the fixing nip N, whereas the finger tips of the second sheet stripper 80*b* are held in direct contact with the pressure roller 60 to allow a recording sheet S to separate from the roller surface at the exit of the fixing nip N.

During operation, the fixing roller 50 rotates in a given direction of rotation (i.e., clockwise in FIG. 3) to rotate the fuser belt 10 in the same rotational direction, which in turn rotates the pressure roller 60 held in sliding contact with the rotating fuser belt 10. Although the present embodiment depicts the motor-driven fixing roller 50 to drive the rotary members, alternatively a rotary motor may be provided to the pressure roller 60 or the heat roller 20, in which case the motor-drive roller initially rotates to in turn rotate the fuser belt 10 and the other rotary members.

The fuser belt 10 during rotation is kept in proper tension with the tension roller 70 pressing against the fuser belt 10 from inside of the belt loop, while having its circumference heated with the heat roller 20 to a given processing temperature sufficient for fusing toner at the fixing nip N.

In this state, a recording sheet S bearing an unfixed, powder toner image T enters the fixing device 100 along a sheet guide 82, with its previously imaged side facing the fuser belt 10 and opposite side brought into contact with the pressure roller 60. As the rotary fixing members rotate together, the recording sheet S is passed through the fixing nip N to fix the toner image in place, wherein heat from the fuser belt 10 causes toner particles to fuse and melt, while pressure from the pressure roller 60 causes the molten toner to settle onto the sheet surface.

At the exit of the fixing nip N, the first and second sheet strippers 80*a* and 80*b*, with their finger tips engageable with the leading edge of the outgoing sheet S, serve to strip the sheet S off the associated rotary members. In general, a recording sheet S having a toner image fixed thereupon tends to adhere and wrap around the rotary fixing members as it exits the fixing nip N. Provision of the first and second sheet strippers 80*a* and 80*b* effectively prevents the recording sheet S from adhering to, and wrapping around, the rotary fixing members as it exits the fixing nip N, which would otherwise result in sheet jam or other malfunctioning of the sheet conveyance mechanism. The recording sheet S thus properly passing through the fixing nip N proceeds to the output unit along the sheet conveyance path P.

With continued reference to FIG. 3, the fixing device 100 is shown having a belt tracking mechanism BT provided on at least one side of the endless belt assembly, including an annular friction flange (annular flange) 21 disposed in an annular recess 20*d* perimetrically formed on a longitudinal end face of the heat roller 20 to rotate freely with respect to the heat roller 20, and a circumferential rib or protrusion 11 extending along a side edge of an interior circumferential surface of the fuser belt or endless belt 10 to contact the annular flange 21 upon lateral movement of the fuser belt 10.

In such a configuration, the belt tracking mechanism BT serves to prevent lateral misalignment or displacement of the fuser belt 10 during rotation, i.e., undesired movement or slippage of the endless belt in the axial, longitudinal direction of the heat roller or belt supporting roller 20, which can occur due to dimensional variations during fabrication, assembly, and/or installation of mechanical components of the fixing device 100. Lateral displacement of the endless fuser belt 10, if not corrected, would result in various operational failures, such as imaging defects and belt breakage, due to improper positioning of the fuser belt 10 relative to the belt support roller 20.

Specifically, where the fuser belt 10 slips laterally in the axial, longitudinal direction of the heat roller 20, the circumferential rib 11 on the interior circumferential surface of the fuser belt 10 contacts the annular flange 21 of the heat roller 20 to restrict lateral movement of the fuser belt 10, thereby maintaining the rotating fuser belt 10 in its proper operational position. As the annular flange 21 disposed in the annular recess 20*d* can rotate freely with respect to the heat roller 20, such belt tracking mechanism can stabilize rotation of the fuser belt 10 without undue load on the fuser belt 10 and the belt support roller 20.

For effective protection against lateral displacement of the fuser belt 10, the annular flange 21 and the circumferential rib 11 may be provided to each longitudinal end of the fuser belt assembly so as to restrict lateral movement of the fuser belt 10 in either longitudinal direction. In this and subsequent embodiments, the endless belt assembly is configured as having the belt tracking mechanism BT provided to both lateral sides, of which only one will be specifically described insofar as the two sides of the assembly are of a substantially identical configuration.

Figure 4:
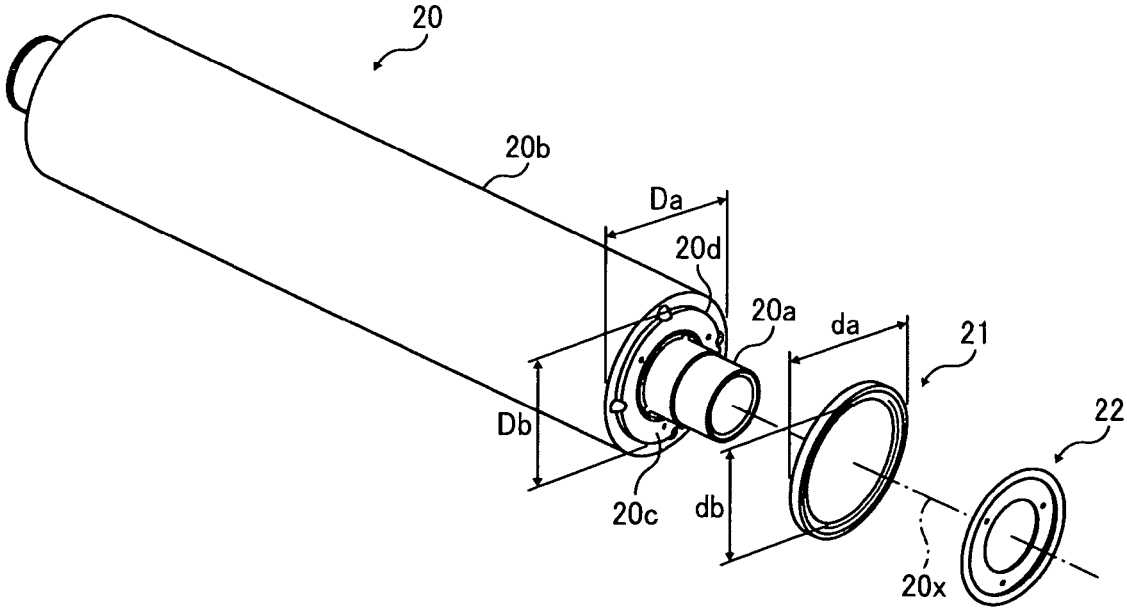
FIG. 4 is an exploded perspective view schematically illustrating a heat roller with its associated structure included in the fixing device of FIG. 3.

FIG. 4 is an exploded perspective view schematically illustrating the heat roller 20 with its associated structure included in the fixing device 100.

As shown in FIG. 4, the heat roller 20 comprises a cylindrical roller body 20*b* mounted on a shaft 20*a* rotatable around a longitudinal, rotational axis 20*x*. The annular recess or recessed surface 20*d* is defined in a longitudinal end face 20*c* of the roller body 20*b* along an outer periphery thereof to accommodate the annular flange 21 therein. An annular retainer disc 22 is connected to the end face 20*c* of the roller body 20*b*, so as to retain the annular flange 21 in position between the retainer disc 22 and the end face 20*c* of the roller body 20*b*.

In the present embodiment, the annular flange 21 is a continuous ring of suitable material selected depending on the specific application or operating temperature at which the fixing device 100 is operated. Examples of such material include resins, such as polyimide (PI), polyetheretherketone (PEEK), polyamide-imide (PAI), and polyphenylene sulfide (PPS), sintered materials, and metals, such as stainless steel or aluminum. The continuous ring annular flange 21 may be surface-treated with a lubricant, such as polytetrafluoroethylene (PTFE) commercially available under the trademark Teflon®, deposited thereupon.

Compared to an annular friction flange fitted around a roller shaft, the annular flange 21 disposed in the annular recess 20*d* of the roller body 20*b* exhibits a smaller difference between the outer and inner diameters of its annular shape, which allows for reduced variations in lateral position of the outer circumference of the annular flange 21 where the annular flange 21 tilts relative to the longitudinal rotational axis 20*x* of the heat roller 20.

Figure 5:
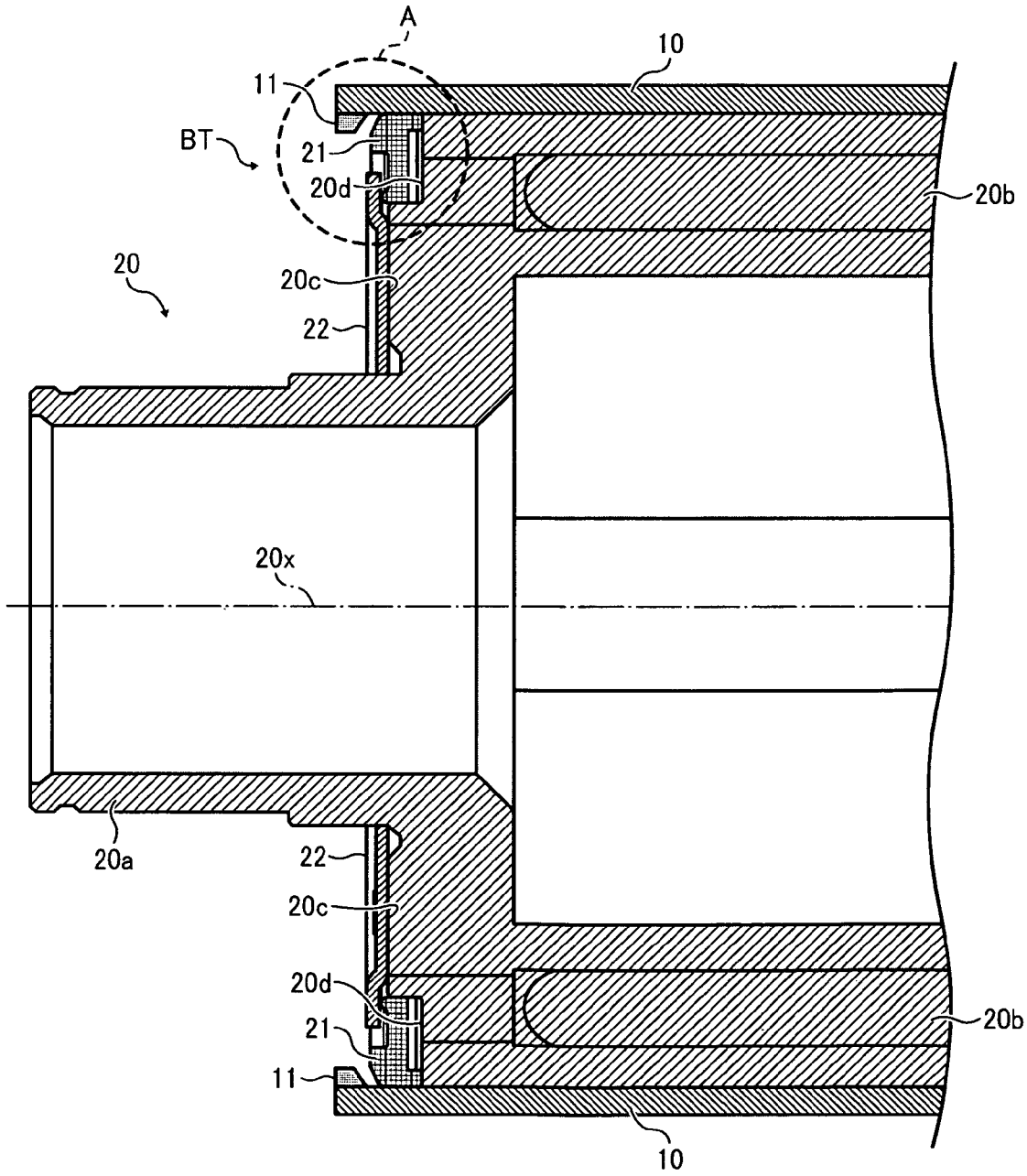
FIG. 5 is a cross-sectional view of a fuser belt assembly included in the fixing device of FIG. 3.

With additional reference to FIG. 5, which is a cross-sectional view of the fuser belt assembly included in the fixing device 100, the annular flange 21, mounted to the end face 20*c* of the roller body 20*b*, has its inner perimeter engaging the adjoining edge of the annular recess 20*d*, which retains the annular flange 21 in position while allowing the annular flange 21 to rotate freely, i.e., independent of and relative to the roller body 20*b*.

The retainer disc 22 has a central opening through which the roller shaft 20*a* is insertable upon mounting to the end face 20*c* of the roller body 20*b*. The retainer disc 22 is fixed in position with its outer perimeter overlapping the inner perimeter of the annular flange 21, so as to prevent disengagement of the free-rotating annular flange 21 from the annular recess 20*d* of the heat roller 20.

Figure 6:
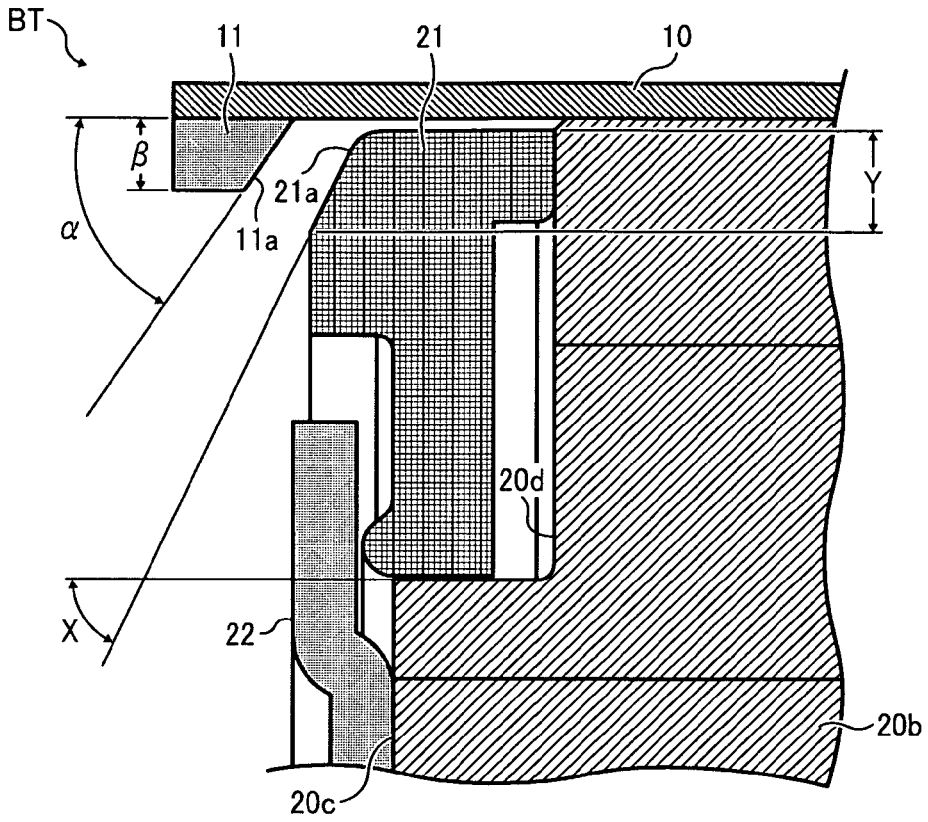
FIG. 6 is an enlarged view of a portion encircled in FIG. 5.

FIG. 6 is an enlarged view of the portion A encircled in FIG. 5.

As shown in FIG. 6, the circumferential rib 11 of the fuser belt 10 comprises an elongated protrusion, substantially perpendicular in cross-section, formed integrally with and protruding inward from the interior circumferential surface of the fuser belt 10. The fuser belt 10 has its circumferential edges positioned outward relative to the longitudinal ends of the heat roller 20, so that the circumferential rib 11 of the fuser belt 10 is positioned outward beyond the annular flange 21 disposed on the end face 20*c* of the heat roller 20.

According to this patent specification, the circumferential rib 11 and the annular flange 21 have their interfacing surfaces inclined at specific angles of inclination relative to the roller rotational axis 20*x*, and extending to specific heights perpendicular to the roller rotational axis 20*x*.

Specifically, the circumferential rib 11 of the fuser belt 10 has an inner, beveled surface 11*a* to face the annular flange 21 of the heat roller 20.

The beveled surface 11*a* is inclined at a first acute angle $\alpha$ relative to the rotational axis 20*x* of the heat roller 20, or more precisely, relative to the surface of the fuser belt 10 which extends substantially parallel to the rotational axis 20*x* where the fuser belt 10 is in proper operational position, so that the beveled surface 11*a* is farthest from the annular flange 21 at a free edge thereof separated from the fuser belt 10, and closest to the annular flange 21 at a fixed edge thereof connected to the fuser belt 10. Also, the beveled surface 11*a* extends from the interior surface of the fuser belt 10 to a height $\beta$ perpendicular to the rotational axis 20*x* of the heat roller 20.

On the other hand, the annular flange 21 of the heat roller 20 has an outer, chamfered surface 21*a* to face the circumferential rib 11 of the fuser belt 10.

The chamfered surface 21*a* is inclined at a second acute angle X relative to the rotational axis 20*x* of the heat roller 20, or more precisely, relative to the flange-engaging wall of the annular recess 20*d* which extends substantially parallel to the rotational axis 20*x*. Also, the chamfered surface 21*a* extends inward from an outermost, circumferential edge of the annular flange 21 to a height Y perpendicular to the rotational axis 20*x* of the heat roller 20.

In such a configuration, the belt tracking mechanism BT can effectively prevent the fuser belt 10 from climbing over the outer circumference of the heat roller 20 to cause failure of the fuser belt 10.

Specifically, where the fuser belt 10 laterally slips, e.g., under nip pressure with which the fuser belt 10 is pressed between the opposed fixing rollers at the fixing nip N, the interfacing surfaces 11*a* and 21*a* of the circumferential rib 11 and the annular flange 21, respectively, are brought into contact with each other, so as to restore the fuser belt 10 to a proper operational position. Having the interfacing surfaces 11*a* and 21*a* beveled or chamfered effectively prevents the circumferential rib 11 from suddenly climbing up the outer perimeter of the annular flange 21.

Further, the annular flange 21, which is freely rotatable with respect to the heat roller 20, can rotate substantially in unison with the circumferential rib 11 as the fuser belt 10 rotates around the heat roller 20. Such uniformity in movement of the annular flange 21 and the circumferential rib 11 effectively prevents the circumferential rib 11 from climbing up the outer perimeter of the annular flange 21 due to difference in linear speed between the fuser belt 10 and the heat roller 20.

Such protection against belt displacement may be promoted by lubricating the interfacing surfaces 11*a* and 21*a* of the circumferential rib 11 and the annular flange 21, respectively. As will be described later, such lubrication reduces friction between the circumferential rib 11 and the annular flange 21, resulting in a reduced tendency of the circumferential rib 11 to creep along the annular flange 21, so that the fuser belt 10 can maintain its proper operational position owing to tensioning force applied thereto.

With continued reference to FIG. 6, according to this patent specification, the second acute angle X at which the chamfered surface 21*a* of the annular flange 21 is inclined relative to the roller rotational axis 20*x* is greater than the first acute angle α at which the beveled surface 11*a* of the circumferential rib 11 is inclined relative to the roller rotational axis 20*x*.

Specifically, the first acute angle α of the beveled surface 11*a* may be set to a range equal to or greater than 45° and smaller than 90°, and the second acute angle X of the chamfered surface 21*a* may be set to a range smaller than 90°, so that a difference X-a between the acute angles falls within a range from 5° to 20°, preferably, from 5° to 10°.

Having the chamfered surface 21*a* steeper or more sharply inclined than the beveled surface 11*a* relative to the roller rotational axis 20*x* effectively prevents the circumferential rib 11 from creeping along the annular flange 21, as the beveled surface 11*a* is less likely to interfere with the chamfered surface 21*a* compared to a configuration where the interfacing surfaces 11*a* and 21*a* have a uniform inclination angle relative to the roller rotational axis 20*x*.

Moreover, designing the chamfered surface 21*a* angled relative to the roller rotational axis 20*x* results in stable, high immunity against failure of the fuser belt 10, compared to a configuration where the chamfered surface 21*a* is positioned at a right angle relative to the roller rotational axis 20*x*, which would result in a greater tendency of the circumferential rib 11 to creep along the annular flange 21 due to a relatively small contact area between the annular flange 21 and the circumferential rib 11 establishing a line contact instead of a surface 11*a* and 21*a* contact between their interfacing surfaces.

Further, in the present embodiment, the height Y to which the chamfered surface 21*a* of the annular flange 21 extends perpendicular to the roller rotational axis 20X is greater than the height β to which the beveled surface 11*a* of the circumferential rib 11 extends perpendicular to the roller rotational axis 20*x*, so that the chamfered surface 21*a* is longer than the beveled surface 11*a* in a radial direction perpendicular to the roller rotational axis 20*x*.

Having the chamfered surface 21*a* radially longer than the beveled surface 11*a* relative to the roller rotational axis 20*x* effectively prevents the circumferential rib 11 from completely climbing up the annular flange 20, wherein the beveled surface 11*a* is less likely to travel along the entire length of the chamfered surface 21*a* to reach the outer edge of the annular flange 21, compared to a configuration where the interfacing surfaces 11*a* and 21*a* have a uniform height perpendicular to the roller rotational axis 20*x*.

Experiments I and II were conducted to investigate the effects of the relative inclination angles and heights of the interfacing surfaces 11*a* and 21*a* of the circumferential rib 11 and the annular flange 21 on susceptibility to failure upon lateral displacement of the fuser belt 10. In the experiments, immunity against belt failure was measured in terms of a lateral displacement speed Vf at which the rotating fuser belt 10 experiences failure as it slips laterally in the axial direction toward the longitudinal end of the heat roller 20. A higher failure-inducing displacement speed Vf indicates an increased immunity against failure of the fuser belt 10, and a lower failure-inducing displacement speed Vf indicates a reduced immunity against failure of the fuser belt 10.

In Experiment I, the failure-inducing displacement speed Vf was measured with a varying acute angle X of the chamfered surface 21*a* of the annular flange 21. Measurement was conducted under a condition with the acute angle α of the beveled surface 11*a* was fixed at 60°, the height β of the beveled surface 11*a* fixed at 1.5 mm, and the height Y of the chamfered surface 21*a* at 2.0 mm.

Figure 7:
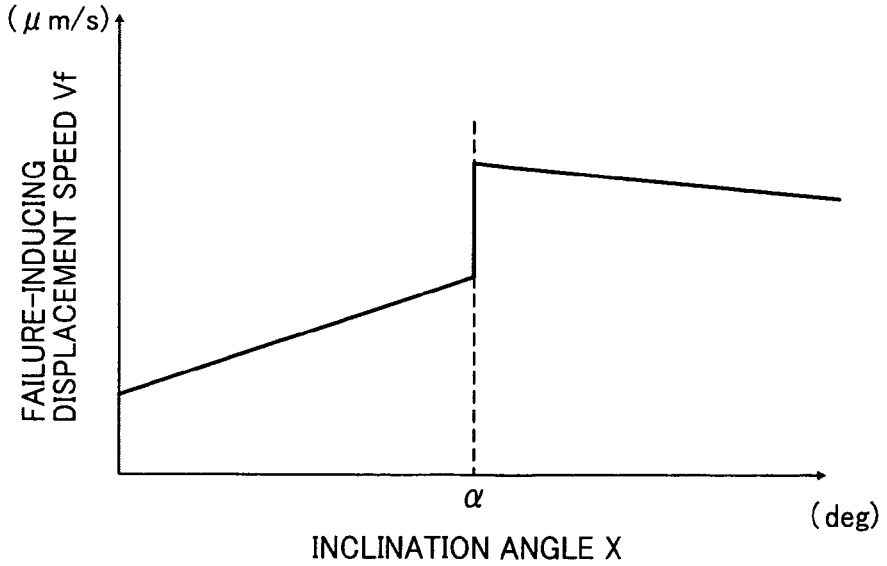
FIG. 7 is a graph showing results of experiments conducted to investigate effects of relative inclination angles of the interfacing surfaces of a belt rib and a roller flange on susceptibility to failure.

FIG. 7 is a graph showing the results of Experiment I, in which the failure-inducing displacement speed Vf of the fuser belt 10 in μm per second is plotted against the acute angle X in degrees of the chamfered surface 21*a*.

As shown in FIG. 7, the failure-inducing displacement speed Vf of the fuser belt 10 varied significantly depending on whether the acute angle X of the chamfered surface 21*a* exceeds the acute angle α of the beveled surface 11*a* (which was in this case fixed at 60°).

Specifically, where the acute angle X remains below the acute angle α, the failure-inducing displacement speed Vf was relatively low, indicating a low immunity against failure of the fuser belt 10. Contrarily, where the acute angle X exceeds the acute angle α, the failure-inducing displacement speed Vf was relatively high, indicating a high immunity against failure of the fuser belt 10. Further, where the acute angle X equals the acute angle α, the failure-inducing displacement speed Vf was not unambiguously identified and variable within a certain moderate range.

Specific experimental results for acute angles X of the chamfered surface 21*a* ranging from 60° to 90° are summarized in TABLE 1 below.

TABLE 1

| INCLINATION ANGLE X | FAILURE-INDUCING DISPLACEMENT SPEED VF | IMMUNITY AGAINST BELT FAILURE |
|---|---|---|
| 60° | Low to high | Unstable |
| 65° | Extremely high | Extremely high and stable |
| 80° | High | High and stable |
| 90° | Low | Undesirably low |

Hence, Experiment I demonstrates that forming the chamfered surface 21*a* steeper or more sharply inclined than the beveled surface 11*a* relative to the roller rotational axis 20*x* results in high and secured immunity against failure due to lateral displacement of the fuser belt 10 during rotation.

In Experiment II, the failure-inducing displacement speed Vf was measured with a varying height Y of the chamfered surface 21*a* of the annular flange 21. Measurement was conducted under a condition with the height β of the beveled surface 11*a* was fixed at 1.5 mm, the acute angle α of the beveled surface 11*a* fixed at 60°, and the acute angle X of the chamfered surface 21*a* at 65°.

Figure 8:
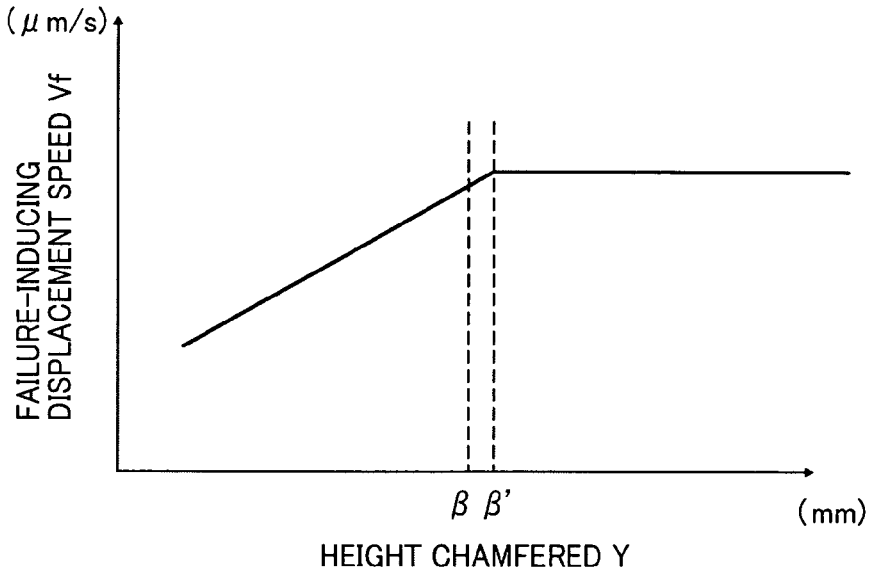
FIG. 8 is a graph showing results of experiments conducted to investigate effects of relative heights of the interfacing surfaces of a belt rib and a roller flange on susceptibility to failure.

FIG. 8 is a graph showing the results of Experiment II, in which the failure-inducing displacement speed Vf of the fuser belt 10 in μm per second is plotted against the height Y in mm of the chamfered surface 21*a*.

As shown in FIG. 8, the failure-inducing displacement speed Vf of the fuser belt 10 increased as the height Y of the chamfered surface 21*a* approaches the height β of the beveled surface 11*a* (which was in this case fixed at 1.5 mm), or more precisely, varied significantly depending on whether the height Y of the chamfered surface 21*a* exceeds a threshold height β' slightly above the beveled surface height β.

Specifically, where the chamfered height Y remains below the threshold height β', the failure-inducing displacement speed Vf was relatively low and increases linearly with the chamfered height Y, indicating a low immunity against failure of the fuser belt 10. Contrarily, where the chamfered height Y exceeds the threshold height β', the failure-inducing displacement speed Vf was relatively high and constant, indicating a high immunity against failure of the fuser belt 10.

Hence, Experiment II demonstrates that forming the chamfered surface 21*a* radially longer than the beveled surface 11*a* relative to the roller rotational axis 20*x* results in high and secured immunity of the fuser belt 10 against failure due to lateral displacement during rotation. The slight difference between the threshold height β ' and the beveled surface height β is attributable to the fact that the fuser belt 10 during operation deforms so that its ribbed edge assumes an apparent height facing the chamfered surface 21*a* which is slightly greater than the original height β as designed.

Figure 9:
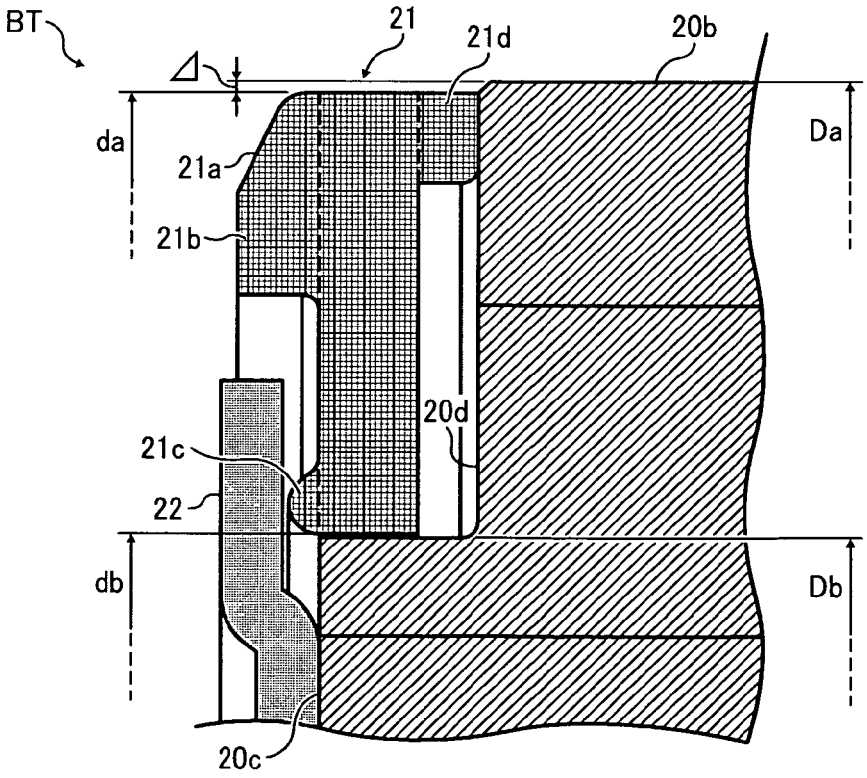
FIG. 9 is another enlarged view of the encircled portion of FIG. 5.

FIG. 9 is another enlarged view of the portion A encircled in FIG. 5, shown without the fuser belt 10 for clarity of illustration.

As shown in FIG. 9, in the present embodiment, the annular flange 21 of the heat roller 20 comprises a circumferentially rimmed, ring-shaped body provided with a raised edge or rim 21*b* on a front face thereof that defines a chamfered surface 21*a* to face the beveled surface 11*a* of the circumferential rib 11.

The annular flange 21 is also provided with a pair of circular ridges or raised surfaces 21*c* and 21*d*, the former extending along the inner perimeter on an outer side of the ring body to face the retainer disc 22, and the latter extending along the outer perimeter on an inner side opposite the outer side of the ring body to contact the annular recess 20*d* of the heat roller 20.

The chamfered surface 21*a* of the annular flange 21 is positioned generally outward relative to the end face 20*c* of the roller body 20*b* in the axial, longitudinal direction parallel to the rotational axis 20*x* of the heat roller 20. That is, the outer edge of the rim 21*b* from which the chamfered surface 21*a* extends radially inward is positioned coplanar with, or offset outward from, the end face 20*c* of the roller body 20*b*.

Such arrangement ensures proper lateral positioning of the fuser belt 10 during rotation, particularly where the fuser belt 10 is required to have a sufficient width that properly accommodates a maximum compatible width of recording media in use, as well as an extra width to contact a thermometer outboard the maximum compatible media width.

Assume, for comparison purposes, that the heat roller 20 is equipped with a non-rimmed annular flange that defines a chamfered edge on its otherwise flat front surface, instead of the rimmed annular flange 21 as depicted in FIG. 9. In such cases, the chamfered surface of the flange would be positioned too distant from the beveled surface of the circumferential rib due to the absence of a raised edge or rim, so that it would not reliably prevent lateral displacement of the fuser belt, resulting in failure or other adverse effects on the fuser belt.

By contrast, the rimmed annular flange 21 according to this patent specification can properly prevent lateral displacement of the fuser belt 10, wherein the chamfered surface 21*a* provided on the raised edge 21*b* on the front side is positioned with proper spacing from the circumferential rib 11 to contact the beveled surface 11*a* where the fuser belt 10 slips laterally from its proper lateral position.

With continued reference to FIG. 9, the annular flange 21 is shown having its outer, raised surface 21*c* disposed radially inward from the chamfered surface 21*a* to face the retainer disc 22, so that the annular flange 21 retained between the retainer disc 22 and the annular recess 20*d* of the roller body 20*b* is freely rotatable with respect to the heat roller 20.

Assume, again for comparison purposes, a configuration wherein the annular flange has a notch for engaging an indented flange mount of a heat roller, which restricts movement of the annular flange in the axial direction while allowing the annular flange to rotate to an extent dictated by the configuration of the engaging notch and indentation. Such a configuration would not work properly where thermal expansion of the heat roller causes the annular flange to interfere with rotation of the heat roller to adversely affect movement of the fuser belt entrained therearound, particularly in a high-speed application that employs a heat roller with a relatively large diameter (e.g., approximately 80 mm or the like).

By contrast, providing the notch-less annular flange 21 with the retainer disc 22 for retention in the annular recess 20*d* of the heat roller 20 according to this patent specification does not adversely affect proper rotation of the heat roller 20 and the fuser belt 10, wherein the annular flange 21, rotatable freely with respect to the cylindrical body 20*b* of the heat roller 20, does not interfere with proper rotation of the heat roller 20 even where the heat roller 20 undergoes dimensional variations due to heat during operation.

Referring back to FIG. 4, the heat roller 20 is shown with an outer diameter Da of the cylindrical body 20*b* and an inner diameter Db of the annular recess 20*d*, as well as outer and inner diameters da and db, respectively, of the annular flange 21. In the present embodiment, the heat roller 20 and the annular flange 21 are dimensioned with respect to each other so as to satisfy, at an operating temperature variable from approximately 20° to approximately 250° Celsius, the following conditions:

$$Da \leq da \quad \text{Eq. 1}$$

$$Db < db \quad \text{Eq. 2}$$

$$da - Da < db - Db \quad \text{Eq. 3}$$

With the equations Eqs. 1 through 3 satisfied, the annular flange 21 disposed in the annular recess 20*d* has its outer periphery positioned radially inward from the circumferential surface of the roller body 20*b* by a certain offset during operation at the variable operating temperature, as shown in FIG. 9.

In the fixing device 100, the endless belt assembly is subjected to heating upon activation of the heater 20*h*, wherein heat from the heater 20*h* is initially conducted to the heat roller 20, which in turn conducts heat to the annular flange 21 subsequently, so that the heat roller 20 and the annular flange 21 experience different degrees of thermal expansion depending on the thermal properties of the constituent material.

Such sequential or non-simultaneous heating of the heat roller assembly causes variations in relative sizes and positions of the heat roller 20 and the annular flange 21 before and after activation of the heater 20*h*. If not corrected, variations in relative sizes and positions of the heat roller 20 and the annular flange 21 would result in various detrimental effects.

For example, the outer periphery of the annular flange 21, which is originally positioned inward from the circumferential surface of the heat roller 20 where the assembly is in a cold, non-operating state, can protrude outward beyond the circumferential surface of the heat roller 20 to thrust against the fuser belt 10 adjacent to the outer edge thereof, which results in increased tendency of the fuser belt 10 slipping laterally to climb over the cylindrical roller body 20*b*.

Further, the annular flange 21 can become smaller in inner diameter than the annular recess 20*d* of the heat roller 20 depending on the thermal properties of the material, which would hinder free rotation of the annular flange 21 relative to the cylindrical roller body 20*b*.

Such detrimental effects of dimensional variations of the heat roller assembly can be mitigated by dimensioning the heat roller 20 and the annular flange 21 to satisfy the conditions Eqs. 1 through 3 described above, which securely prevents failure of the fuser belt 10 due to thermal expansion of the annular flange 21 and the heat roller 20, while securing proper free rotation of the annular flange 21.

Preferably, the circumferential rib 11 and the annular flange 21 have their interfacing surfaces 11*a* and 21*a* appropriately lubricated, so that a kinetic frictional coefficient of the circumferential rib 11 on the annular flange 21 is approximately 0.1 at a pressure-velocity (PV) factor of 500 kgf/$cm^2$*m/min. Such lubrication between the circumferential rib 11 and the annular flange 21 may be accomplished by applying a suitable lubricant or grease to the interfacing surfaces 11*a* and 21*a* of the circumferential rib 11 and the annular flange 21 and/or by selecting suitable materials for the respective components 11 and 21 which can move against each other without undue friction.

Experiment III was conducted to investigate the effects of lubrication of the interfacing surfaces 11*a* and 21*a* of the circumferential rib 11 and the annular flange 21 on susceptibility to failure upon lateral displacement of the fuser belt 10. In the experiments, immunity against belt failure was measured in terms of a lateral displacement speed Vf at which the rotating fuser belt 10 experiences failure as it slips laterally in the axial direction toward the longitudinal end of the heat roller 20, as is the case with Experiments I and II.

In Experiment III, the failure-inducing belt displacement speed Vf was measured as the circumferential rib 11, formed of silicone rubber, and the annular flange 21, formed of PI, were lubricated to vary the coefficient of kinetic friction therebetween at a PV factor of 500 kgf/$cm^2$*m/min, so as to obtain a relation between the failure-inducing displacement speed Vf of the fuser belt 10 and the kinetic frictional coefficient of the circumferential rib 11 on the annular flange 21.

Figure 10:
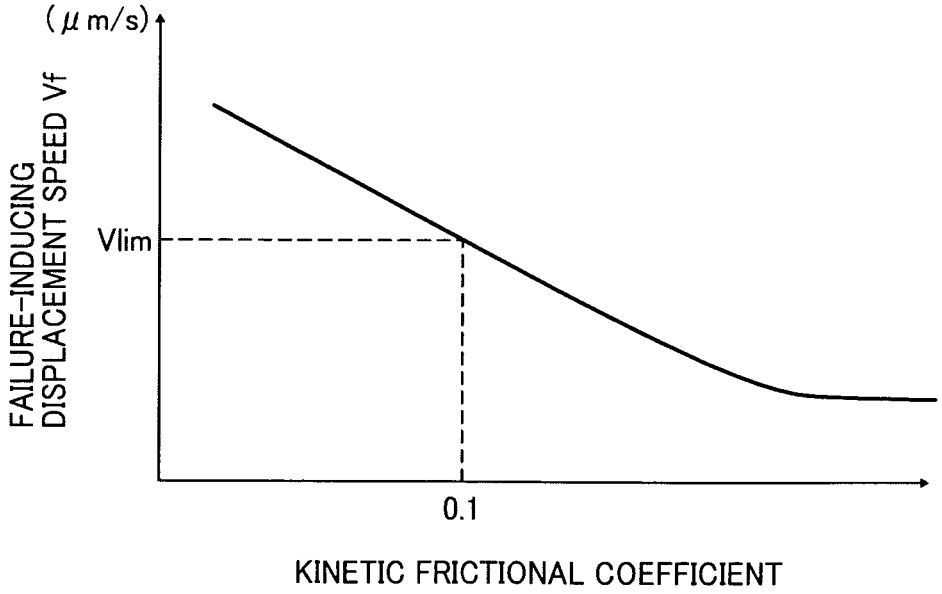
FIG. 10 is a graph showing results of experiments conducted to investigate effects of lubrication of the interfacing surfaces of a belt rib and a roller flange on susceptibility to failure.

FIG. 10 is a graph showing the results of Experiment III, in which the failure-inducing belt displacement speed Vf in μm is plotted against the kinetic frictional coefficient.

As shown in FIG. 10, the failure-inducing belt displacement speed Vf decreases inversely with the kinetic frictional coefficient, indicating that too high a kinetic frictional coefficient results in insufficient immunity against failure upon lateral slippage of the fuser belt 10. Such inverse variation of the failure-inducing speed Vf with the kinetic frictional coefficient is attributable to the fact that increased friction between the interfacing surfaces 11*a* and 21*a* of the circumferential rib 11 and the annular flange 21 provides a stable foothold with which the circumferential rib 11 climbs more readily along the chamfered surface 21*a* to reach the outer edge of the annular flange 21.

Note that, at a kinetic frictional coefficient of 0.1, the failure-inducing displacement speed Vf reaches a minimum allowable limit Vlim on the failure-inducing belt displacement speed Vf, which is normally approximately 500 μm, although variable depending on the specific configuration of the fixing device 100, the rotational speed of the fuser belt 10, and the setup of the mechanical components. Such experimental results indicate that lubricating the circumferential rib 11 and the annular flange 21 to obtain a kinetic frictional coefficient of approximately 0.1 effectively prevents failure due to lateral displacement of the fuser belt 10.

Although in several embodiments depicted above, the belt tracking mechanism BT is described with the annular flange 21 provided on the heat roller 20 for preventing lateral displacement of the fuser belt 10 ribbed along its circumferential edge, the annular flange 21 may be provided to any one or more of the multiple belt-support rollers, except for the nip-forming fixing roller which may assume a deformed non-true cylindrical configuration uncomformable with the annular flange 21 when subjected to nip pressure during operation.

In such embodiments, providing the annular flange 21 selectively on a roller that has a wrapped circumference (i.e., the area by which the roller contacts the fuser belt 10) larger than the other belt-support rollers effectively prevents belt displacement without undue load on the fuser belt 10, owing to an elongated linear contact established between the circumferential rib 11 and the annular flange 21 upon lateral displacement of the fuser belt 10.

Further, although in several embodiments depicted above, the endless belt assembly is described as being incorporated in a fuser belt assembly of a fixing device, the belt tracking mechanism BT according to this patent specification is applicable to any endless belt device that includes an endless belt entrained around one or more belt support rollers, such as an intermediate transfer unit employed in an electrophotographic image forming apparatus as disclosed herein.

Numerous additional modifications and variations are possible in light of the above teachings. It is therefore to be understood that, within the scope of the appended claims, the disclosure of this patent specification may be practiced otherwise than as specifically described herein.

What is claimed is:

1. An endless belt assembly comprising:

one or more rollers disposed parallel to each other, each being rotatable around a rotational axis thereof;

an endless belt looped for rotation around the rollers; and a belt tracking mechanism disposed on at least one side of the endless belt assembly to prevent lateral displacement of the endless belt during rotation, the belt tracking mechanism including:

an annular recess perimetrically formed on a longitudinal end face of the roller;

an annular flange disposed in the annular recess to rotate freely with respect to the roller; and a circumferential rib extending along a side edge of an interior circumferential surface of the endless belt to contact the annular flange upon lateral movement of the endless belt, the circumferential rib having an inner, beveled surface to face the annular flange, the beveled surface being inclined at a first acute angle relative to the rotational axis of the roller, so that the beveled surface is farthest from the annular flange at a free edge thereof separated from the endless belt, and closest to the annular flange at a fixed edge thereof connected to the endless belt, the annular flange having an outer, chamfered surface to face the circumferential rib, the chamfered surface being inclined at a second acute angle greater than the first acute angle relative to the rotational axis of the roller.

2. The endless belt assembly according to claim 1, wherein the chamfered surface of the annular flange is longer than the beveled surface of the circumferential rib in a radial direction perpendicular to the rotational axis of the roller.

3. The endless belt assembly according to claim 1, wherein the chamfered surface of the annular flange is positioned generally outward relative to the end face of the roller in an axial direction parallel to the rotational axis of the roller.

4. The endless belt assembly according to claim 1, wherein the belt tracking mechanism further includes a retainer disc connected to the end face of the roller, so as to retain the annular flange in position between the retainer disc and the end face of the roller.

5. The endless belt assembly according to claim 4, wherein the annular flange has an outer, raised surface disposed radially inward from the chamfered surface thereof to face the retainer disc, so that the annular flange retained is freely rotatable with respect to the roller.

6. The endless belt assembly according to claim 1, wherein the roller and the annular flange are dimensioned with respect to each other so as to satisfy the following conditions:

$$Da \leq da$$

$$Db < db$$

$$da - Da < db - Db$$

where "da" denotes an outer diameter of the annular flange, "db" denotes an inner diameter of the annular flange, "Da" denotes an outer diameter of the roller, and "Db" denotes an inner diameter of the annular recess of the roller.

7. The endless belt assembly according to claim 1, wherein the circumferential rib and the annular flange have interfacing surfaces lubricated with respect to each other, so that a kinetic frictional coefficient of the circumferential rib on the annular flange is approximately 0.1 or smaller at a pressure-velocity factor of 500 $kgf/cm^2$*m/min.

8. The endless belt assembly according to claim 1, wherein a difference between the first and second acute angles falls within a range from approximately 5 degrees to approximately 20 degrees.

9. The endless belt assembly according to claim 1, wherein a difference between the first and second acute angles falls within a range from approximately 5 degrees to approximately 10 degrees.

10. A fixing device for fixing a toner image onto a recording medium, the fixing device comprising:

one or more fixing rollers disposed parallel to each other, each being rotatable around a rotational axis thereof;

a heated endless fuser belt looped for rotation around the fixing rollers;

a pressure member disposed opposite the endless fuser belt to form a fixing nip therebetween, through which the recording medium is passed to fix the toner image with heat and pressure; and a belt tracking mechanism disposed on at least one side of the endless fuser belt to restrict lateral movement of the endless fuser belt, the belt tracking mechanism including:

an annular recess perimetrically formed on a longitudinal end face of the fixing roller;

an annular flange disposed in the annular recess to rotate freely with respect to the fixing roller; and a circumferential rib extending along a side edge of an interior circumferential surface of the endless fuser belt to contact the annular flange upon lateral movement of the endless fuser belt, the circumferential rib having an inner, beveled surface to face the annular flange, the beveled surface being inclined at a first acute angle relative to the rotational axis of the fixing roller, so that the beveled surface is farthest from the annular flange at a free edge thereof separated from the endless fuser belt, and closest to the annular flange at a fixed edge thereof connected to the endless fuser belt, the annular flange having an outer, chamfered surface to face the circumferential rib, the chamfered surface being inclined at a second acute angle greater than the first acute angle relative to the rotational axis of the fixing roller.

11. An image forming apparatus comprising:

one or more rollers disposed parallel to each other, each being rotatable around a rotational axis thereof;

an endless belt looped for rotation around the rollers; and a belt tracking mechanism disposed on at least one side of the endless belt assembly to prevent lateral displacement of the endless belt during rotation, the belt tracking mechanism including:

an annular recess perimetrically formed on a longitudinal end face of the roller;

an annular flange disposed in the annular recess to rotate freely with respect to the roller; and a circumferential rib extending along a side edge of an interior circumferential surface of the endless belt to contact the annular flange upon lateral movement of the endless belt, the circumferential rib having an inner, beveled surface to face the annular flange, the beveled surface being inclined at a first acute angle relative to the rotational axis of the roller, so that the beveled surface is farthest from the annular flange at a free edge thereof separated from the endless belt, and closest to the annular flange at a fixed edge thereof connected to the endless belt, the annular flange having an outer, chamfered surface to face the circumferential rib, the chamfered surface being inclined at a second acute angle greater than the first acute angle relative to the rotational axis of the roller.

* * * * *